US010223889B2

(12) United States Patent
Park et al.

(10) Patent No.: US 10,223,889 B2
(45) Date of Patent: Mar. 5, 2019

(54) EMERGENCY DETECTION AND RESPONSE SYSTEM USING LED-LIGHTING MODULE, AND METHOD THEREOF

(71) Applicant: JPK KOREA CO., LTD., Seoul (KR)

(72) Inventors: Jong Min Park, Seoul (KR); Seok Tae Kim, Suwon-si (KR); Hong Min Lee, Bucheon-si (KR); Yoon Il Koh, Seoul (KR)

(73) Assignee: JPK Korea Co., Ltd., Seoul (KR)

( * ) Notice: Subject to any disclaimer, the term of this patent is extended or adjusted under 35 U.S.C. 154(b) by 0 days.

(21) Appl. No.: 15/569,919

(22) PCT Filed: Apr. 28, 2016

(86) PCT No.: PCT/KR2016/004450
§ 371 (c)(1),
(2) Date: Oct. 30, 2017

(87) PCT Pub. No.: WO2016/175574
PCT Pub. Date: Nov. 3, 2016

(65) Prior Publication Data

US 2018/0151046 A1 May 31, 2018

(30) Foreign Application Priority Data

Apr. 30, 2015 (KR) ..... 10-2015-0061739

(51) Int. Cl.
*G08B 3/00* (2006.01)
*G08B 5/36* (2006.01)
(Continued)

(52) U.S. Cl.
CPC ..... *G08B 21/02* (2013.01); *F21V 23/045* (2013.01); *F21V 33/00* (2013.01);
(Continued)

(58) Field of Classification Search
CPC ..... F21Y 2115/10; H04L 65/1023
(Continued)

(56) References Cited

U.S. PATENT DOCUMENTS 6,166,633 A 12/2000 Wang
9,466,211 B1 * 10/2016 Gesmundo ..... G08G 1/091
(Continued)

FOREIGN PATENT DOCUMENTS

CN 103035105 4/2013
JP 2014-002559 1/2014
(Continued)

OTHER PUBLICATIONS

KIPO, an Office Action Notice of KR 10-2015-0061739 dated Nov. 9 2015.
(Continued)

*Primary Examiner* — Fabricio R Murillo Garcia
(74) *Attorney, Agent, or Firm* — Lex IP Meister, PLLC

(57) ABSTRACT

Disclosed is an emergency detection and response system using LED-lighting modules. The emergency detection and response system using LED-lighting modules, according to the present invention, comprises: a plurality of LED-lighting modules having an emergency sensor for sensing an emergency and a communication sensor; a communication network for, if an emergency is detected by the emergency sensor, receiving emergency detection signals transmitted via the communication sensor and providing the emergency detection signals to an operation unit; a control unit for controlling the LED-lighting modules according to control signals received from the operation unit or a specific emergency detection signal among the emergency detection signals; and a cloud platform for building, as a database, the emergency detection signals received from the communication network or the control signals corresponding to the
(Continued)

emergency detection signals and transmitting an early warning signal on the basis of the received signals.

10 Claims, 4 Drawing Sheets

(51) Int. Cl.

| | |
|---|---|
| ***F21V 23/04*** | (2006.01) |
| ***F21V 33/00*** | (2006.01) |
| ***G08B 17/00*** | (2006.01) |
| ***G08B 21/02*** | (2006.01) |
| ***G08B 21/12*** | (2006.01) |
| ***G08B 23/00*** | (2006.01) |
| ***G08B 25/10*** | (2006.01) |
| ***G08B 29/18*** | (2006.01) |
| ***H05B 37/02*** | (2006.01) |
| ***F21Y 115/10*** | (2016.01) |

(52) U.S. Cl.
CPC ..... *F21V 33/0076* (2013.01); *G08B 3/00* (2013.01); *G08B 5/36* (2013.01); *G08B 17/00* (2013.01); *G08B 21/12* (2013.01); *G08B 23/00* (2013.01); *G08B 25/10* (2013.01); *G08B 29/185* (2013.01); *H05B 37/02* (2013.01); *F21Y 2115/10* (2016.08)

(58) Field of Classification Search
USPC ..... 340/691.8
See application file for complete search history.

(56) References Cited

U.S. PATENT DOCUMENTS

| | | | | |
|---|---|---|---|---|
| 2010/0148672 | A1* | 6/2010 | Hopper | F21V 23/0435 315/113 |
| 2014/0340216 | A1 | 11/2014 | Puskarich | |
| 2015/0061859 | A1 | 3/2015 | Matsuoka et al. | |
| 2015/0154860 | A1* | 6/2015 | Holzwanger | G08G 1/005 340/944 |
| 2015/0364027 | A1* | 12/2015 | Haupt | G01W 1/02 340/521 |
| 2017/0038018 | A1* | 2/2017 | Johnson | H05B 37/0227 |
| 2017/0238401 | A1* | 8/2017 | Sadwick | A61N 5/01 315/294 |

FOREIGN PATENT DOCUMENTS

| | | |
|---|---|---|
| KR | 20-2009-0011022 | 10/2009 |
| KR | 10-0972837 | 7/2010 |
| KR | 10-2013-0034077 | 4/2013 |
| KR | 10-1311016 | 9/2013 |

OTHER PUBLICATIONS

SIPO, Office Action of CN 201680024991.4 dated Nov. 22, 2018.
EPO, extended European search report of EP 16786760.5 dated Oct. 4, 2018.

* cited by examiner

EMERGENCY DETECTION AND RESPONSE SYSTEM USING LED-LIGHTING MODULE, AND METHOD THEREOF

CROSS-REFERENCE TO RELATED APPLICATIONS

This U.S. non-provisional patent application claims priority under 35 U.S.C. § 119 of Korean Patent Application No. 10-2015-0061739, filed on Apr. 30, 2015, the entire contents of which are hereby incorporated by reference.

TECHNICAL FIELD

The present invention relates to an emergency detection and response system using an LED-lighting module and a method thereof, and more particularly to an emergency detection and response system using an LED-lighting module capable of grafting a sensor and a network onto an LED-lighting module installed anywhere in a building to detect an emergency situation and respond to the emergency situation within a golden time, and a method thereof.

BACKGROUND ART

Recently, a social interest in disaster and safety countermeasure is being heightened as incidents that become social issues occur. In particular, since most cases are such that the golden time for rescue is missed to cause huge losses of human lives, the importance of swift initial response after disaster occurrence is magnified. As a solution thereto, not only revision and supplement for related laws, and education and disciple for human resources are important, but it is also an urgent need to prepare a disaster response system of an advanced country level through automation of active response such as a golden time target system for each disaster type, which solves the situation within 5 minutes from occurrence of the situation.

In addition, it is necessary to establish an integrated system capable of swiftly evacuating and guiding people to an optimal path, the integrated system being provided with sensors for predicting or instantly detecting disasters and crimes of various scenarios, and a system capable of optimizing situation recognition that enables proper analysis and prediction for phenomena without a false alarm, and for instantly propagating the situation of a disaster occurrence with the most efficient method.

Typically, in order to cope with an emergency situation such as a fire, various facilities are installed in a building according to defined laws. A representative facility may be a sprinkler. The sprinkler is configured such that a sprinkler head is installed per a certain area, the sprinkler head is connected to a pipe, and then fire fighting water at a certain pressure is supplied to the pipe. Upon occurrence of fire, the sprinkler head bursts due to a temperature rise by the fire and the fire fighting water is spouted to put out the fire. At this point, a hydraulic pressure of an alarm valve installed on the pipe drops due to discharge of the fire fighting water, and the alarm valve rings to inform occurrence of the fire. Currently, most of fire detection systems are operated as the above-described system.

Beside the above-described fire and disaster response system, various sensors and facilities such as a CCTV, alarm monitoring, a dangerous substance detecting sensor, voice recognition, and a building collapse detecting sensor are used for monitoring and responding to various disaster situations as well as the fire situation. However, it is very inefficient in that most of the disaster response systems using the above-described sensors are independent as a stand-alone system, and are independently operated.

DISCLOSURE OF THE INVENTION

Technical Problem

The present invention provides an emergency detection system using an LED-lighting module capable of swiftly responding within the golden time upon occurrence of disaster by mounting various disaster detecting sensors in the LED-lighting module and connecting the same with each other through a network.

The present invention also provides an emergency detection system using an LED-lighting module capable of interacting information detected by the LED-lighting module with a cloud-based IT fusion platform for disaster response to prepare for a disaster situation and also performing synthetic determination so as not to occur a false alarm through a big data analysis.

Technical Solution

In accordance with an embodiment of the present invention, an emergency detection and response system using an LED-lighting module, including: a plurality of LED-lighting modules, each of which being provided with an emergency detecting sensor configured to detect an emergency situation and a communication sensor; a communication network configured to receive an emergency situation detection signal transmitted through the communication sensor and transmit the emergency situation detection signal to a operation unit, when the emergency situation is detected by the emergency detecting sensor; a control unit configured to control the LED-lighting modules according to a specific emergency situation detection signal from between an operation signal or the emergency situation detection signal received from the operation unit; a cloud platform configured to build a database of the emergency situation detection signal received through the communication network or the emergency situation detection signal and the operation signal corresponding thereto, and transmit an early warning signal on a basis of the received signals, wherein the communication sensor is an infrared ray communication sensor or a visible ray communication sensor.

Preferably, each of the plurality of LED-lighting modules may include a camera so as to transmit image information for an emergency situation upon occurring the emergency situation.

Preferably, each of the plurality of LED-lighting modules may include a speaker so as to deliver a voice or a warning sound for the emergency situation and an evacuation signal upon occurring the emergency situation.

Preferably, the emergency detecting sensor may include one selected from among a fire detecting sensor, a volatile organic compound detecting sensor, a building collapse detecting sensor, and a voice recognition sensor, or a combination thereof.

Preferably, each of the plurality of LED-lighting modules may communicate with an adjacent LED-lighting module through the communication sensor and a prescribed number of the LED-lighting modules are divided into groups.

Preferably, in the plurality of LED-lighting modules, a main LED-lighting module configured to finally collect the emergency situation signal may be determined in each group and connected to the communication network.

Preferably, the emergency detection and response system using an LED-lighting module may further include a communication equipment for obstacle negotiation provided with communication sensors at both ends such that each of plurality of the LED-lighting modules overcomes a communication failure due to a long distance or an obstacle, and configured to connect the communication sensors to each other in a wired manner.

Preferably, the control unit may control the LED-lighting modules through an Ethernet, Wi-Fi, or Bluetooth.

Preferably, the cloud platform may further include: at least one processing device configured to provide a computing capability; and a memory configured to provide a storage capacity.

Preferably, the received emergency situation detection signal and the operation signal may be stored in the memory of the cloud platform, and the processing device may compare the emergency situation detection signal and the operation signal built as the database with each other to build another database of a false alarm error case to store the other database in the memory.

In accordance with another embodiment of the present invention, an emergency detection and response method using an LED-lighting module includes: an emergency situation detecting step for detecting an emergency situation by an emergency detecting sensor installed in an LED-lighting module; a communication step for transmitting an emergency situation detection signal detected in the emergency situation detecting step to a communication network through a communication sensor provided in the LED-lighting module; a operating step for receiving, by the operation unit, the emergency situation detection signal through the communication network and transmitting, by the operation unit, an operation signal; a control step for controlling, by a control unit, the LED-lighting module as an evacuation mode, when the operation signal in the operating step is an emergency situation operation signal, wherein in the control step, when the operation signal in the operating step is a false alarm error operation signal, the control unit controls the LED-lighting module as a reset mode.

Preferably, the emergency detection and response method using an LED-lighting module may further include a database building step for storing, in a memory of a cloud platform through the communication network, the emergency situation detection signal received in the communication step and the operation signal transmitted in the operating step, and classifying, by a processing device of the cloud platform, the emergency situation detection signals stored in the memory into the emergency situation operation signals or false alarm error operation signals to store a classified result in the memory.

Preferably, the emergency detection and response method using an LED-lighting module may further include an early warning signal transmitting step for comparing, by the processing device, the emergency situation detection signal with the database stored in the memory to determine the emergency situation detection signal as the emergency situation operation signal or the false alarm error operation signal, and providing a determination result to the operation unit, when the emergency situation detection signal is received by the cloud platform.

Preferably, the early warning signal may be transmitted to a personal terminal existing within a certain radius from the LED-lighting module having received the emergency situation detection signal.

Advantageous Effects

According to the above-described present invention, there are following effects.

(1) An emergency detection and response system using an LED-lighting module according to the present invention is configured to detect an emergency situation using an LED-lighting module installed per a certain area in a building and be able to transmit a detection result to a operation unit through a communication network, and provides an effect of enabling a swift response.

(2) An emergency detection and response system using an LED-lighting module according to the present invention provides an effect of swiftly detecting a false alarm error, etc., to transmit an evacuation signal, when receiving the emergency situation detection signal is received by learning, through a cloud platform, an emergency situation detection signal detected by an LED-lighting module, or an operation signal of an operation unit together with the emergency situation detection signal.

DESCRIPTION OF MAIN PARTS OF DRAWINGS

Figure 1:
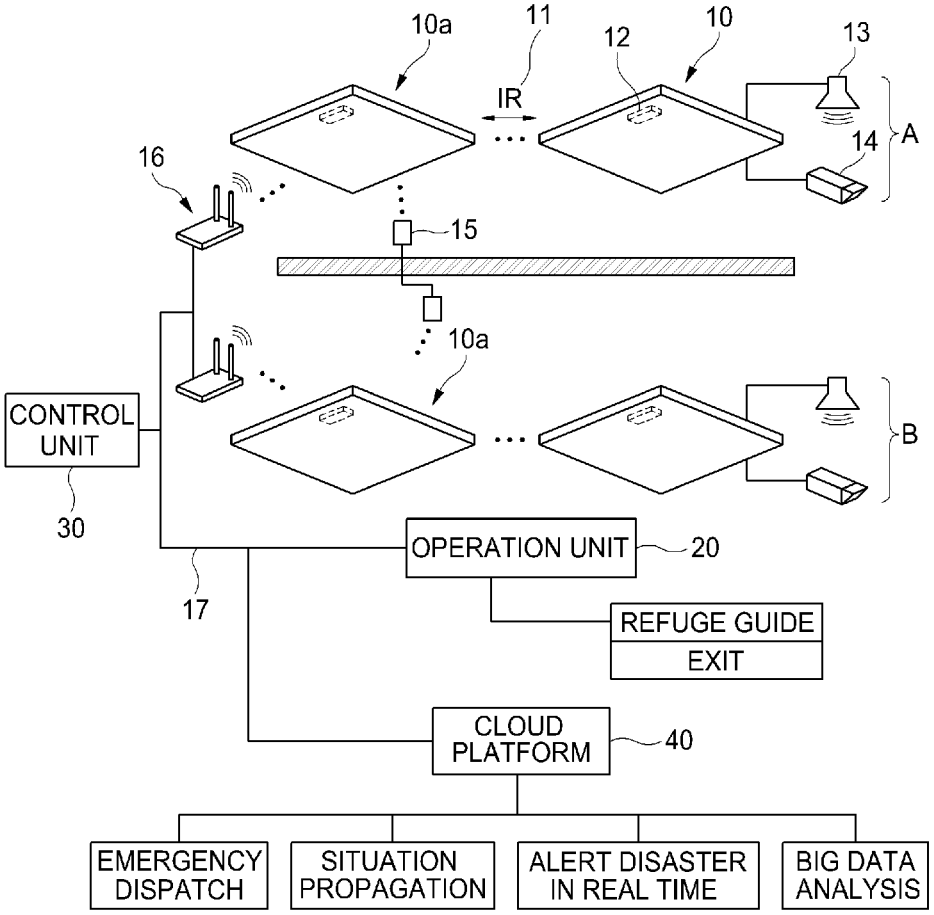
FIG. 1 is a schematic diagram of an emergency detection and response system using an LED-lighting module according to the present invention.

10: LED-lighting module
10*a*: Main LED-lighting module
11: Communication sensor
12: Emergency detecting sensor
13: Speaker
14: Camera
15: Communication equipment for obstacle negotiation
16: Wi-Fi
17: Communication network
20: Operation unit
30: Control unit
40: Cloud platform
50: Personal terminal

MODE FOR CARRYING OUT THE INVENTION

The foregoing objects, features and advantages of the invention will be more apparent from the following description. Hereinafter, it will be described about an exemplary embodiment of the present invention in conjunction with the accompanying drawings.

An emergency detection and response method using an LED-lighting module according to a preferred embodiment of the present invention includes, as shown in FIGS. 1 to 4, an LED-lighting module 10, a communication network 17, a control unit 30, and a cloud platform 40.

The LED-lighting module 10 is provided with an emergency detecting sensor 12 for detecting an emergency situation, and a communication sensor 11. The LED-lighting module 10 basically includes a plurality of LED-lighting modules, a power supply device for supplying power to the LED-lighting modules, a light guiding plate for guiding optical sources of the LED-lighting modules to a lower portion, a diffusion plate laminated with the light guiding plate, and components such as a frame. Typically, lighting devices are installed in almost all portions with difference in frequency. For the lighting device, current fluorescent light is gradually being replaced with the LED lighting. Accordingly, in the future, replacement with the LED lighting will be entirely performed inside a building.

The LED-lighting module 10 is provided with an emergency detecting sensor 12. The emergency detecting sensor 12 may be driven using power of the LED-lighting module 10.

Figure 2:
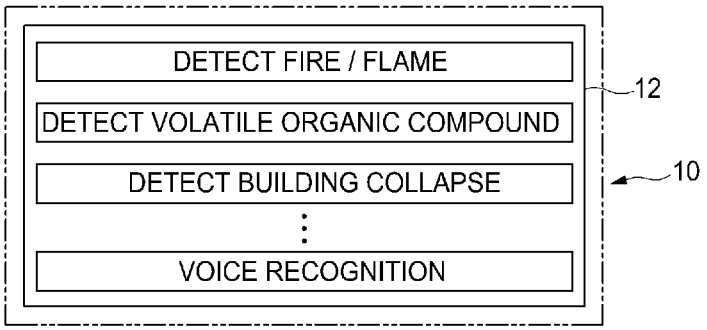
FIG. 2 is a block diagram of a detecting sensor that is a part of elements of an emergency detection and response system using an LED-lighting module according to the present invention.
Figure 3:
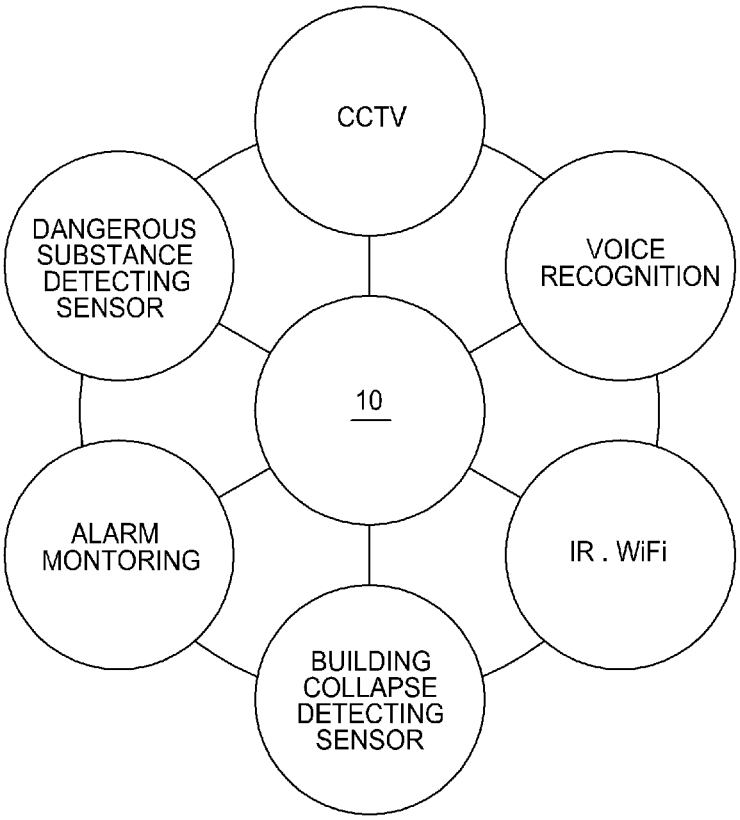
FIG. 3 is a configuration of an LED-lighting module that is a part of elements of an emergency detection and response system using an LED-lighting module according to the present invention.

The emergency detecting sensor 12, as shown in FIG. 2, may be any one selected from among a fire detecting sensor, a volatile organic compound detecting sensor, a building collapse detecting sensor, and a voice recognition sensor, or a combination thereof. In other words, all the referred sensors may be mounted therein. However, it is required to provide at least any one emergency detecting sensor.

The emergency detecting sensor 12 is literally a sensor for detecting an emergency situation, and there may be various kinds of sensors. Besides the above-described sensors, any one for detecting an emergency situation may be adopted as the emergency detecting sensor.

The emergency situation may be a fire in a building, as a representative example. For a sensor for detecting a fire, there are many kinds of sensors and the accuracy is significantly high according to repeated technical developments.

As the fire detecting sensor, a constant-temperature spot-type heat detector, a rate of rise spot type heat detector, a photoelectric spot type heat detector, an ionization spot type heat detector, a flameproof spot type heat detector, and a line type fixed temperature detector, etc, are currently being sold. A flame detector using an infrared ray has also been developed. The flame detector is a detector for detecting and amplifying a wavelength in a so-called 'CO2 resonance radiation band' with a pyroelectric element through an optical filter to transmit a fire signal.

The volatile organic compound detecting sensor is typically composed in a type of a gas detector for detecting a gas, and Volatile Organic Compounds indicate hydrocarbon compounds to be volatilized in the air to give out a bad smell or ozone, which are a cancer-causing agent causing a nervous system problem through a skin contact or respiratory inhalation. Benzene, formaldehyde, toluene, xylene, ethylene, styrene, acetaldehyde, etc., are collectively called as the volatile organic compounds.

The building collapse detecting sensor is a sensor installed at a key point at which a load of a building is supported and for predicting or detecting a collapse of the building.

The voice/sound source recognition sensor detects, as an emergency situation, a voice or sound source generated by an occurrence of the emergency situation. For example, the sensor detects a blast, screams of people, a specific word, etc., and based on these, transmits a detection signal for the emergency situation.

It is natural that various kinds of sensors may be mounted as the emergency detecting sensor 12, besides the above-described sensors.

The LED-lighting module 10 is provided with a communication sensor 11, and the communication sensor 11 may be an infrared ray communication (IR) sensor or a visible ray communication sensor. Currently, in an optical communication field, a visible ray is used, but there are many more cases where an infrared ray is used as a transfer medium. The infrared ray may smoothly pass particles in the air with a longer wavelength than that of the visible ray, and easily secure a wider bandwidth than a radio wave, when a distance between devices is short, and therefore data transmission may be advantageously performed in a high speed. There are shortcomings of the infrared ray in that a communicable distance is as short as several meters, and a transmitter and a receiver of both sides are required to face each other.

Since, in an installed state, most of the LED-lighting modules 10 are separated by several meters from each other at an identical height, an application of the infrared communication sensor is the most appropriate. Accordingly, as shown in FIG. 1, the LED-lighting module 10 becomes able to communicate with an adjacent lighting module 10 through the infrared communication sensor 11. The LED-lighting modules 10 may be divided into groups, each of which has the prescribed number of LED-lighting modules. It may be seen in FIG. 1 that the LED-lighting modules 10 are divided into group A and group B.

For the LED-lighting modules 10, a main LED-lighting module 10*a* for collecting an emergency situation signal may be determined in each group. The main LED-lighting module 10*a* is connected to the communication network 17, and the remaining LED-lighting module 10 delivers information to the main LED-lighting module 10*a* without being connected to the communication network 17. In this way, by dividing the LED-lighting modules 10 into groups and determining the main LED-lighting module 10*a*, an equipment for connection to the communication network 17 may be minimized. Naturally all the LED-lighting modules 10 may also be connected to the communication network 17. In this case, a concept of so-called Internet of Things (IoT) may be executed through the communication network 17. Although only the main LED-lighting module 10*a* is configured to be connected to the communication network 17, the IoT configuration and operation may be implemented at some degree through the infrared communication sensor 11.

The LED-lighting module 10 may be provided with a camera 14 so as to transmit image information for an emergency situation upon occurrence thereof. The camera 14 may be configured to change a capturing position under a control of the control unit 30. Accordingly, the camera 14 is configured to be installed one by one in groups A and B so as to be controlled.

The LED-lighting module 10 may be provided with a speaker 13 so as to deliver an emergency situation and an evacuation signal through a voice or a warning sound upon occurrence of the emergency situation. When the emergency situation occurs, the control unit 30 is configured to drive, as a feedback therefor, the speaker 14 through the LED-lighting module 10. The output from the speaker 14 may indicate a detailed cause of fire occurrence, etc., and be represented with a language to be delivered to the surrounding people, or may instantly output a warning sound of very high decibel to call attention of the surrounding people.

An emergency detection and response system using the LED-lighting module 10 may be provided with a communication equipment for obstacle negotiation 15. Referring to FIG. 1, the communication equipment for obstacle negotiation 15 may be provided with communication sensors at both ends thereof such that the LED-lighting module 10 overcomes a communication failure due to a long distance or an obstacle, and connect the communication sensors to each other in a wired manner. In other words, as shown in FIG. 1, two infrared communication sensors are wired such that one end thereof communicates with a main LED-lighting module 10*a* of group A and the other end thereof communicates with a main LED-lighting module 10*a* of group B. In other words, when separated by a wall, etc., since a failure occurs in an infrared communication sensor, such a communication failure may be overcome using the communication equipment for obstacle negotiation 15. Accordingly, group A and group B may be combined to one group.

When the emergency situation is detected by the emergency detecting sensor 12, the communication network 17 receives the emergency situation detection signal having been transmitted through the communication sensor 11 and provides the same to the operation unit 20.

Here, the operation unit 20 means a main agent for receiving the emergency situation detection signal, generating an operation signal corresponding thereto, and transmitting the operation signal to the control unit 30 and/or the cloud platform 40. In order to manage the emergency situation, this operation unit 20 may be configured from any one of or a plurality of a terminal of a manager who manages a space to which the system of the present invention is applied, a management office terminal of a building to which the space belongs, and a management center terminal that centrally manages an emergency situation occurring in another space from a remote place.

The communication network 17 is typically the Internet. The communication network 17 transmits, in a wired or wireless manner, information obtained from the LED-lighting module 10 to the operation unit 20. Referring to FIG. 1, for the LED-lighting module 10 of group A and the LED-lighting module 10 of group B, each main LED-lighting module 10*a* wirelessly transmits/receives signals through a gateway 16. The gateway 16 is connected to the operation unit 20 through a wired/wireless network to transmit signals collected from the LED-lighting modules 10. It is natural that the main LED-lighting module 10*a* may be directly connected to the wired/wireless network without passing through the gateway 16.

The communication network 17 may also connect the control unit 30 to the cloud platform 40 to allow the control unit 30 and the cloud platform 40 to transmit/receive signals to/from each other.

The control unit 30 controls the LED-lighting module 10 according to the operation signal of the operation unit 20. Here, the 'operation signal' means a signal transmitted, to the control unit 30, by the above-described manager, management office, or management center in response to the emergency situation detection signal so as to control (for example, control to turn on/off a lighting module so as to perform guidance to an escape route upon a fire occurrence) the LED-lighting module 10. In addition, even if not the emergency situation, the operation signal also includes a signal transmitted to the control unit 30 so as to control (for example, control to raise an output of the lighting for cleaning a space in which the LED-lighting module 10 is installed) the LED-lighting module 10 according to necessity of the manager, the management office or the management center.

On the other hand, in addition to the control of the LED-lighting module 10 according to the operation signal, the control unit 30 may control the LED-lighting module 10 in a preset manner, when receiving 'a specific emergency situation detection signal' from among the emergency situation detection signals, even if not receiving the operation signal. Here, 'the specific emergency situation detection signal' means, for example, an emergency situation detection signal corresponding to a situation in a high probability of fire occurrence, as in a case where fire detection signals are received from two or more adjacent LED-lighting modules. In the case of receiving such a specific emergency situation detection signal, the control unit 30 may instantly recognize the emergency situation as a fire occurrence situation, and swiftly control the LED-lighting module 10 to an evacuation mode.

The control unit 30 may be configured to control the LED-lighting module 10 through an Ethernet, Wi-Fi, or Bluetooth. The control may also be performed through the wired network, when the LED-lighting module 10 is directly connected to the wired network, The control unit 30 may control the LED-lighting module 10 according to a signal transmitted from the operation unit 20 or the cloud platform 40, and control not only on/off of the LED-lighting module 10, but also an angle of the camera 14 or a voice or the volume thereof emitted from the speaker 13.

The control unit 30 may be manufactured in a mobile terminal type so as to be carried by the manager. The manager may carry and move the control unit of the mobile terminal type, and control separately the LED-lighting module using Wi-Fi, Bluetooth, etc.

The cloud platform 40 continuously builds a database of the emergency situation detection signal and the operation signal received from the operation unit 20, and transmits an early warning signal on the basis of the received signal.

The cloud platform 40 includes at least one processing device for providing a computing capability and a memory for providing a storage capacity. The cloud platform 40, as an element capable of realizing cloud computing, accompanies deliveries of services hosted through a network like the Internet, and provides deliveries of a computing capacity and a storage capacity to end users. Accordingly, in order to realize such cloud computing, the processing device and memory are necessary.

As described above, the cloud platform 40 is provided with such cloud computing capability, and the cloud computing typically includes a plurality of servers or nodes 41. As described above, each of the nodes 41 is provided with a processing device and a memory in order to provide the cloud computing capability. The nodes 41 together configure a cloud platform. Since each node 41 is provided with the processing capability and memory, a user, namely, a local computer may remotely operate an application, or store data on a cloud or cluster of nodes, instead of operating the application or storing the data. In other words, the local computer that is an end user may access a cloud-based application through a web browser or any other software application, and a software application or data related to the software application may be stored or executed on the cloud nodes 41 located remotely.

Here, the LED-lighting module 10 and the control unit 30 may correspond to the end user or local computer. In other words, when the LED-lighting module 10 delivers only data to the cloud platform 40 through a communication network, the data is stored in the cloud platform 40 and the application is also operated on the node 41 to transmit the result to the control unit 30.

Computing tasks to be processed on the cloud platform 40 are distributed across the plurality of nodes 41 in a workload type. The nodes 41 operate to share workload processing. A workload container operates on the nodes 41 so that the workload may be performed and shared on the nodes 41. In other words, the workload container is an execution framework for workloads for providing a software environment in which the nodes 41 start to execute and organize workloads on the cluster of the nodes 41. The workload container configures the related node 41 to operate as a cloud node 41 so that the node 41 is allowed to execute the workload, share results of executing the workload with other nodes 41 of the cloud platform 40, cooperate and communicate with the other nodes 41. For example, the workload is a Java-based Apache Hadoop and provides a map-reduce framework and distributive file system (HDFS) for map-reduce workloads. The workload is a composite processor requiring a steep learning curve setting up or configuring a cluster of the nodes 41 in the cloud platform 40, but as described above, may be implementable by purchasing a currently commercialized program.

Figure 4:
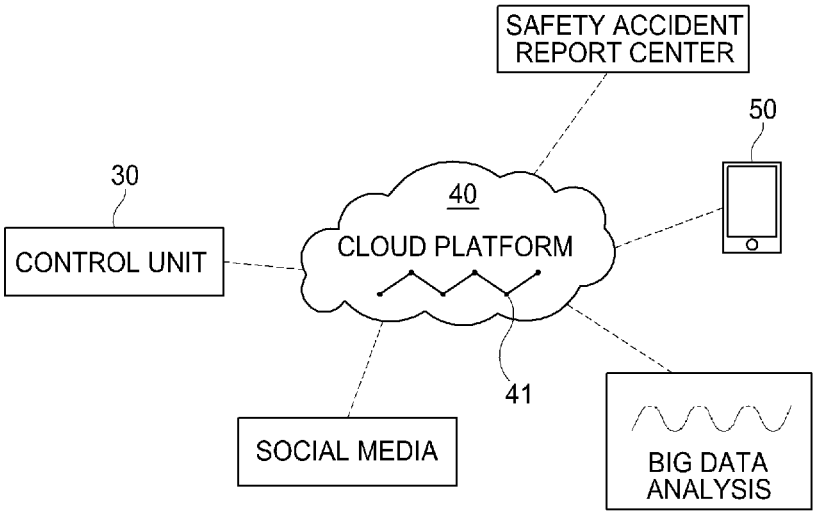
FIG. 4 is a communication connection block diagram of a cloud platform that is a part of elements of an emergency detection and response system using an LED-lighting module according to the present invention.

As shown in FIG. 4, the cloud platform 40, continuously stores, in a memory to build a database, the emergency situation detection signal received through the communication network 17 from the LED-lighting module 10, or an operation signal received through the communication network 17 from the operation unit 20 together with the emergency situation detection signal, and performs learning by executing the workload on the basis of the accumulated data, and transmits an early warning signal. In other words, the received emergency situation signal and operation signal are stored in the memory of the cloud platform 40, and the processing device compares the emergency situation detection signal and the operation signal stored as the database with each other to build a database of false alarm error cases and store the database in the memory. Repeating this process enables deep learning in a very fast speed.

A program for building the database and receiving the data to transmit the early warning signal performed in the cloud platform 40, as shown in FIG. 1, is to prevent the disaster by discerning a dangerous element through monitoring at ordinary times by the sensor 12 embedded in the LED-lighting module 10, and, when a danger is detected, predicting the dangerous situation through a big data-based multivariat analysis of a disaster response platform on the basis of a context awareness technology. The big data includes not only a huge amount of data itself, but also manpower, organization, and technology necessary for managing and analyzing the same. In this sense, the big data is an analysis scheme for extracting values from a large structured or unstructured data set and analyzing a result thereof, which exceeds capability for collecting, storing, managing, and analyzing data with an existing database management tool. Such a big data analysis scheme is grafted onto database building.

For example, a fire is detected by a certain LED-lighting module 10 and this fire detection is transmitted to the operation unit 20. The operation unit 20 determines as the fire and transmits an early warning signal. Such a series of data is stored on a certain node 41 of the cloud platform 40 and is continuously collected and accumulated. In other words, data in a case where the fire detection is connected to an actual early warning signal is accumulated and stored, and learning is performed based thereon. When learning is performed on a certain amount of data, the cloud platform 40 performs a workload on an emergency detection signal received from the LED-lighting module 10 in a certain node 41 to determine whether it is an actual emergency situation or a detection error, and transmit an early warning signal by various routes using the communication network 17. Accordingly, upon receiving the emergency situation detection signal from the LED-lighting module 10, the cloud platform 40 may respond to the emergency situation within a golden time by not waiting for an operation signal, but transmitting an early warning signal.

Figure 5:
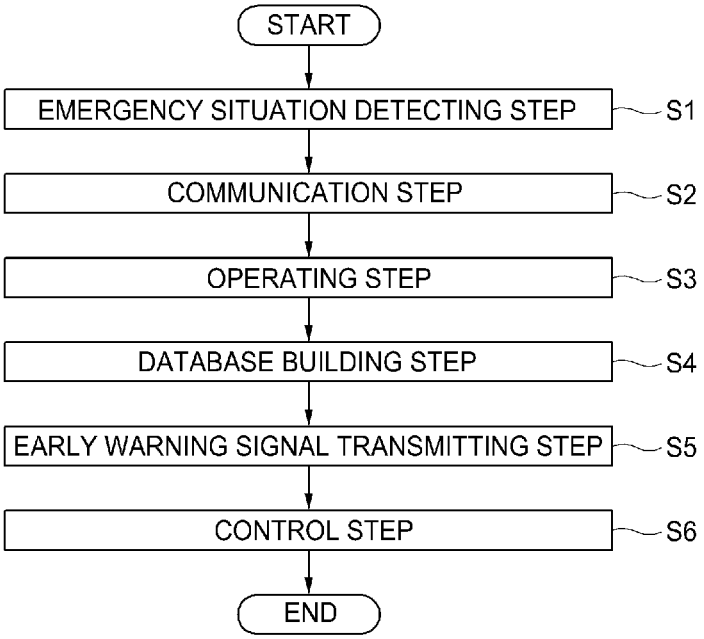
FIG. 5 is a flowchart of an emergency detection and response method using an LED-lighting module according to the present invention.

On the other hand, referring to FIG. 5, an emergency situation detection and response method using an LED-lighting module includes an emergency situation detecting step S1, a communication step S2, an operating step S3, a database building step S4, an early warning signal transmitting step S5, and a control step S6.

The emergency situation detecting step S1 is a step for detecting an emergency situation with the emergency detecting sensor 12 installed in the LED-lighting module 10. As shown in FIG. 2 and described above, the emergency detecting sensor 12 may be any one selected from among a fire detecting sensor, a volatile organic compound detecting sensor, a building collapse detecting sensor, and a voice recognition sensor, or a combination thereof.

The communication step S2 is a step for transmitting the emergency situation detection signal detected in the emergency situation detecting step S1 to the communication network 17 through the communication sensor 11 provided in the LED-lighting module 10. As the communication sensor 11 provided in the LED-lighting module 10, an infrared communication sensor or a visible ray communication sensor is useable. The communication network 17 typically means the internet.

The operating step S3 is a step for receiving, by the operation unit 20, the emergency situation detection signal through the communication network 17 and transmitting, by the operation unit 20, the operation signal. The emergency situation detection signal transmitted from the LED-lighting module 10 is received by the operation unit 20, and the operation unit 20 checks whether the emergency detection signal is for an actual emergency situation, transmits the operation signal as an evacuation signal in case of the emergency situation, or as an error signal otherwise.

The database building step S4 is a step for storing the emergency situation detection signal received in the communication step S2 and the operation signal transmitted in the operating step S3 in a memory of the cloud platform 40 through the communication network 17, classifying, by the processing device of the cloud platform 40, the emergency situation detection signals stored in the memory into emergency situation operation signals and false alarm error operation signals, and storing the classified signals in the memory. When received from the LED-lighting module 10, the emergency situation detection signal is stored in a memory of one node 41 in the cloud platform 40 and an operation signal corresponding to the emergency situation detection signal is also stored therein. It is natural that the operation signal may be an evacuation signal or an error signal. In the node 41, the emergency situation detection signal is classified by type by the workload and the result is stored in the memory. By repeating such a process, which emergency situation detection signal actually becomes an error signal is gradually accumulated and built as a database.

In the database building step S4, the workload container of the cloud platform 40 learns a relation between the emergency situation detection signal and error signal using the data stored in each node 41. It is natural that as a data amount larger, the accuracy becomes very high.

The early warning signal transmitting step S5 is a step in which when the emergency situation detection signal is received by the cloud platform 40, the processing device compares the received signal with the database stored in the memory to determine the emergency situation detection signal to be an emergency situation operation signal or a false alarm error operation signal, and provides the determined result to the operation unit 20. As described above, such an operation may be performed by the workload container of the cloud platform 40.

The early warning signal may be not only transmitted to a safety report center, an emergency center, social media, etc., besides the operation unit 20, but also transmitted to a personal terminal 50 existing within a certain radius from the LED-lighting module 10 having received the emergency situation detection signal. Accordingly, people carrying the personal terminal 50 within the certain radius from a place where the actual emergency situation occurs may receive the early warning signal and swiftly and distantly evacuate.

The control step S6 is a step for controlling, by the control unit 30, the LED-lighting module 10 as an evacuation mode, when the operation signal of the operation unit S3 is the emergency situation operation signal. The control unit S6 may control the LED-lighting module 10 as a reset mode, when the operation signal is the false alarm error operation signal. In the evacuation mode, on/off of the LED-lighting module 10 installed on an evacuation path is repeated at a certain time interval in an aspect of securing the evacuation path in order to evacuate the people and guide the people to be swiftly evacuated, and the people are swiftly informed about the emergency situation through the speaker 13 to be guided along the evacuation path. As a more detailed example, at the time of emergency escape in the evacuation mode, a front lighting of an emergency exit is adjusted to have double luminous intensity or more than other lightings such that the people see the bright light to escape, and a high frequency speaker is mounted only in the front side of the emergency exit to guide the people to a direction in which a high frequency sound is generated. In addition, a circumstantial determination is performed using data received from the camera 14, and based thereon, an evacuation path is newly changed or closed to execute swift evacuation. In the reset mode, the LED-lighting module 10 is reset to neglect the emergency situation detection signal.

In the evacuation mode, when a disaster such as a fire or explosion occurs, an early warning system instantly operates to guide an aid recipient to be swiftly evacuated through voice evacuation guidance, flickering, etc., by an LED system lighting, and automatically executes a follow-up process according to a field standard operating procedure (SOP). A portion for automatic processing and alarming based on the SOP is input in advance to a response-to-disaster IT fusion platform.

When an emergency detection and response system using an LED-lighting module according to the present invention is applied to a typical building, in a technical aspect, a new IT fusion technology is developed in which technologies having been individually installed and operated are fused, an innovative technology is achieved in which an LED-lighting device is made to a platform with various sensors mounted thereon, and a low production cost and low power consumption of infrared (IR) communication are realized by an IT interactive network backbone technology.

Furthermore, in an economic aspect, individually installed sensors are integrated into an LED system lighting to minimize a cost, the integration leads a drop of a royalty fee, installation cost, and maintenance cost to proliferate a disaster responsive building, and a new fusion technology market is developed to achieve technical innovation and synergy between related industries of a danger detecting sensor, an integrated IT industry such as deep learning/big data analysis, intelligent LED system lighting, etc.

In addition, in a social aspect, a danger in advance may be prevented through application to a place where a considerable damage is expected at the time of disaster occurrence such as a public space, public use establishment, or dangerous substance establishment, 'a golden time' for saving a life may be ensured by the new IT fusion technology at the time of disaster occurrence, and the way may be paved to strengthen a national disaster safety network by grafting an advanced IT technology onto disaster prevention.

The above-described present invention is not limited to the above-described embodiments and the accompanying drawings, and it will be clear to those having ordinary skill in the technical field to which the present invention pertains that various replacements, variations and modifications can be made without departing from the technical spirit of the present invention.

INDUSTRIAL APPLICABILITY

The present invention provides an emergency detection and response system using an LED-lighting module capable of grafting a sensor and a network system onto an LED-lighting module installed anywhere in a building to detect an emergency situation and respond to the emergency situation within a golden time.

The invention claimed is:

1. An emergency detection and response system using an light emitting diode (LED)-lighting module, the emergency detection and response system being characterized by comprising:

a plurality of LED-lighting modules, each of which being provided with an emergency detecting sensor configured to detect an emergency situation and a communication sensor;

a communication network configured to receive an emergency situation detection signal transmitted through the communication sensor and transmit the emergency situation detection signal to an operation circuit, when the emergency situation is detected by the emergency detecting sensor;

a control circuit, configured to control the LED-lighting modules according to a specific emergency situation detection signal from between an operation signal or the emergency situation detection signal received from the operation circuit, and as an evacuation mode, only when the operation signal is an emergency situation operation signal of the emergency situation, by controlling a plurality of LED lights operatively connected to the LED-lighting module to show an evacuation path to users for evacuating from the emergency situation;

wherein the emergency situation operation signal is determined based on recurrent predicted multivariate analysis between the emergency situation detection signal and the operation signal;

a cloud platform configured to build a database of the emergency situation detection signal received through the communication network or both the emergency situation detection signal and the operation signal corresponding to the emergency situation detection signal, and transmit an early warning signal on a basis of the emergency situation detection signal received through the communication network, wherein the communication sensor is an infrared ray communication sensor or a visible ray communication sensor.

2. The emergency detection and response system using the LED-lighting module according to claim 1, wherein each of the plurality of LED-lighting modules is characterized by comprising a camera so as to transmit image information for the emergency situation upon occurring the emergency situation.

3. The emergency detection and response system using the LED-lighting module according to claim 1, wherein each of the plurality of LED-lighting modules is characterized by comprising a speaker so as to deliver a voice or a warning sound for the emergency situation and the evacuation signal upon occurring the emergency situation.

4. The emergency detection and response system using the LED-lighting module according to claim 1, wherein the emergency detecting sensor is characterized by comprising at least one selected from among a fire detecting sensor, a volatile organic compound detecting sensor, a building collapse detecting sensor, and a voice recognition sensor.

5. The emergency detection and response system using the LED-lighting module according to claim 1, wherein each of the plurality of LED-lighting modules is characterized by communicating with an adjacent LED-lighting module through the communication sensor and a prescribed number of the LED-lighting modules are divided into groups.

6. The emergency detection and response system using the LED-lighting module according to claim 5, wherein, the plurality of LED-lighting modules are characterized in that a main LED-lighting module configured to finally collect the emergency situation signal is determined in each group and is connected to the communication network.

7. The emergency detection and response system using the LED-lighting module according to claim 1, the emergency detection and response system being characterized by further comprising:

a communication equipment for obstacle negotiation provided at both ends of each of the communication sensors such that each of plurality of the LED-lighting modules overcomes a communication failure due to a long distance or an obstacle, and configured to connect the communication sensors to each other in a wired manner.

8. The emergency detection and response system using the LED-lighting module according to claim 1, wherein the control circuit is characterized by controlling the LED-lighting modules through an Ethernet, Wi-Fi, or Bluetooth.

9. The emergency detection and response system using the LED-lighting module according to claim 1, wherein the cloud platform is characterized by comprising:

at least one processing device configured to provide a computing capability; and a memory configured to provide a storage capacity.

10. The emergency detection and response system using the LED-lighting module according to claim 9, wherein the received emergency situation detection signal and the operation signal are characterized by being stored in the memory of the cloud platform, and the processing device compares the emergency situation detection signal and the operation signal built as the database with each other to build another database of a false alarm error case to store the other database in the memory.

* * * * *